US012480266B1

(12) United States Patent
Heim

(10) Patent No.: US 12,480,266 B1
(45) Date of Patent: Nov. 25, 2025

(54) RAPID DEPLOY MOBILE PEDESTRIAN BRIDGE

(71) Applicant: James Christian Heim, Warwick, NY (US)

(72) Inventor: James Christian Heim, Warwick, NY (US)

( * ) Notice: Subject to any disclaimer, the term of this patent is extended or adjusted under 35 U.S.C. 154(b) by 0 days.

(21) Appl. No.: 19/292,247

(22) Filed: Aug. 6, 2025

(51) Int. Cl.
*E01D 15/12* (2006.01)
*E01D 15/127* (2006.01)
*E01D 21/10* (2006.01)

(52) U.S. Cl.
CPC ..... *E01D 15/124* (2013.01); *E01D 15/127* (2013.01); *E01D 21/10* (2013.01)

(58) Field of Classification Search
CPC ..... E01D 15/124; E01D 15/127; E01D 21/10; E04B 1/3441
USPC ..... 14/69.5–72.5
See application file for complete search history.

(56) References Cited

U.S. PATENT DOCUMENTS 892,686 A * 7/1908 Schneider et al. .... E04B 1/3441 52/109
1,114,718 A * 10/1914 Audet ..... E04B 1/3441 280/30
1,593,999 A * 7/1926 Bingham et al. ..... E01D 15/127 14/2.4
1,733,587 A * 10/1929 Ebeling ..... E01D 15/06 404/1
3,593,481 A * 7/1971 Mikulin ..... E04H 12/187 52/632
4,084,713 A * 4/1978 Rohrs ..... A61G 3/061 414/537
4,628,560 A * 12/1986 Clevett ..... E01D 15/127 211/202
7,140,467 B2 * 11/2006 Cook ..... B60R 3/005 182/141
7,350,254 B2 * 4/2008 Boulton ..... E01D 15/124 14/2.4
8,561,239 B2 * 10/2013 Honeycutt ..... E01D 15/24 14/71.3
8,959,694 B2 * 2/2015 Clarke ..... E01D 15/06 14/71.3

FOREIGN PATENT DOCUMENTS

FR 2764926 A1 * 12/1998 ..... E01F 9/696
GB 2110648 A * 6/1983 ..... B66F 3/22

* cited by examiner

*Primary Examiner* — Raymond W Addie
(74) *Attorney, Agent, or Firm* — Walter J. Tencza, Jr.

(57) ABSTRACT

An apparatus which includes an expandable lift device; and an expandable bridge span. The expandable lift device is configured to raise the expandable bridge span, while the expandable bridge span is in a compressed state and is substantially aligned with the expandable lift device. Next, the expandable bridge span is configured to rotate about ninety degrees with respect to the expandable lift device, while the expandable bridge span is in the compressed state; and thereafter the expandable bridge span is configured to expand perpendicularly to the expandable lift device.
The apparatus may further include first and second staircases, which are configured to be attached to first and second ends, respectively of the extended expandable bridge span. A method is provided of deploying the apparatus to provide a removable bridge structure.

13 Claims, 11 Drawing Sheets

RAPID DEPLOY MOBILE PEDESTRIAN BRIDGE

FIELD OF THE INVENTION

This invention relates to devices for temporary pedestrian bridges.

BACKGROUND OF THE INVENTION

Over the roadway pedestrian bridge options currently available to event organizers are expensive and take several hours, if not days, to install and dismantle. Street based special events have incredibly small operational windows in order to minimize community disruption. Roadways typically only close thirty to sixty minutes before participants arrive. Event organizers are always looking for ways to minimize impact on the community. A fast-deployed and cost-effective mobile pedestrian bridge allowing for unimpeded crowd flow over a racecourse, parade, etc. would be a game changer for mass participation events.

Large scale festival events share a similar challenge and are also rapidly increasing in size. Though festival events may not face quite the same pressure on operational timeline as road-based events, these are still temporary environments that need to be built to accommodate crowd flow for the population of a small city. A fast and cost-effective solution to provide a second plane of crowd flow would be a useful tool for festivals and other forms of mass gathering events.

SUMMARY OF THE INVENTION

A mobile rapid deploy pedestrian bridge utilizing two custom fabricated box trucks. Both trucks are outfitted with already available collapsable staircase sections, decking sections and railing sections stored in the truck boxes. One of the trucks is equipped with a hydraulic lift to raise the bridge span/cross section above the truck, and then an articulating scissor cross section that extends across to the other truck where it anchors in place. The articulating scissor design allows for the width of the bridge span to be customized to any distance between fifteen feet and forty-two feet. Once the bridge is locked into place sectional flooring/decking pieces, railings and stairs are installed to complete the bridge. The bridge span can also be customized with banners/signage.

In at least one embodiment, an apparatus is provided which includes an expandable lift device; and an expandable bridge span; wherein the expandable lift device is connected to the expandable bridge span; wherein the expandable lift device is configured to raise the expandable bridge span, while the expandable bridge span is in a compressed state and is substantially aligned with the expandable lift device; thereafter wherein the expandable bridge span is configured to rotate about ninety degrees with respect to the expandable lift device, while the expandable bridge span is in the compressed state; and thereafter wherein the expandable bridge span is configured to expand perpendicularly to the expandable lift device.

In at least one embodiment of the present invention, the apparatus may further include a first staircase; and wherein the first staircase is configured to be attached to the expandable bridge span, at a first end of the expandable bridge span, when the expandable bridge span is in a first expanded state to allow a human being to walk up the first staircase and then onto a walkway device supported by the expandable bridge span.

In at least one embodiment, the apparatus may further include a first truck with a cargo enclosure; and wherein when both the expandable bridge span and the expandable lift device are in a compressed state and connected together, both the expandable bridge span and the expandable lift device fit within the cargo enclosure.

In at least one embodiment, the apparatus may include a second truck; and wherein, in the first expanded state, the expandable bridge span is configured to span from the first truck to the second truck.

The apparatus may further include a second staircase; and wherein the second staircase is configured to be attached to a second end of the expandable bridge span, which is opposite the first end of the expandable bridge span, when the expandable bridge span is in the first expanded state to allow a human being to walk up the first staircase, then onto the walkway device, supported by the expandable bridge span, and then onto the second staircase. The second staircase, in a compressed state, may be configured to fit within a cargo enclosure of the second truck.

In at least one embodiment, a method is provided which may include placing an expandable lift device in a compressed state and an expandable bridge span in a compressed state in a cargo enclosure of a first truck; raising the expandable bridge span while the expandable bridge span is in a compressed state and is substantially aligned with the expandable lift device; rotating the expandable bridge span ninety degrees or about ninety degrees with respect to the expandable lift device, while the expandable bridge span is in the compressed state; and expanding the expandable bridge span perpendicularly to the expandable lift device.

The method may further include attaching a first staircase to the expandable bridge span, at a first end of the expandable bridge span, when the expandable bridge span is in a first expanded state to allow a human being to walk up the first staircase and then onto a walkway device supported by the expandable bridge span.

The method may further include expanding the expandable bridge span so that it spans from the first the first truck to a second truck.

The method may further include attaching a second stair case to a second end of the expandable bridge span, which is opposite the first end of the expandable bridge span, when the expandable bridge span is in the first expanded state to allow a human being to walk up the first staircase, then onto the walkway device, supported by the expandable bridge span, and then onto the second staircase. The second staircase, in a compressed state, may be configured to fit within a cargo enclosure of the second truck.

DETAILED DESCRIPTION OF THE DRAWINGS

Figure 1A:
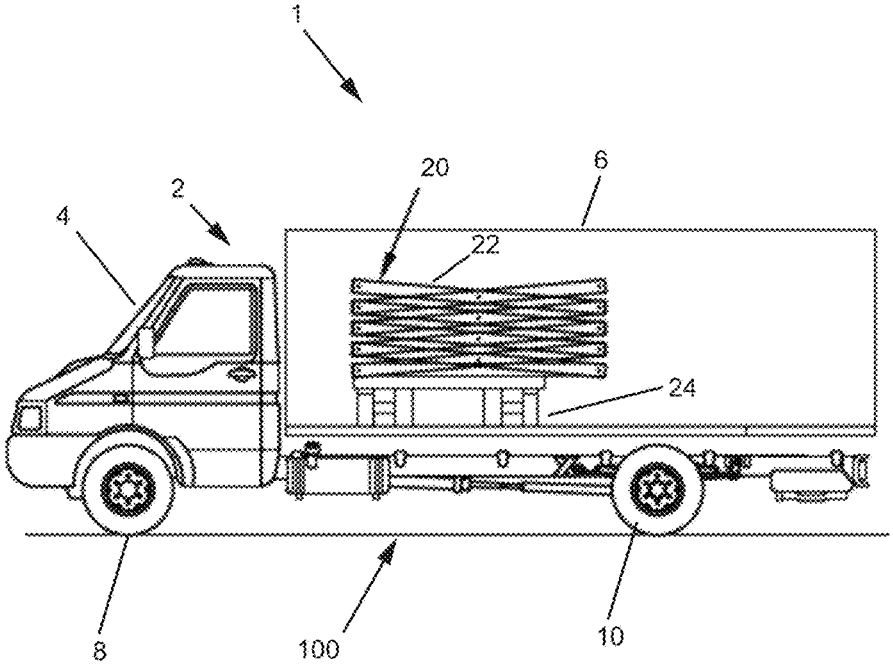
FIG. 1A is a right side view of an apparatus including a first truck and a first device, with the first device in a first state.
Figure 1B:
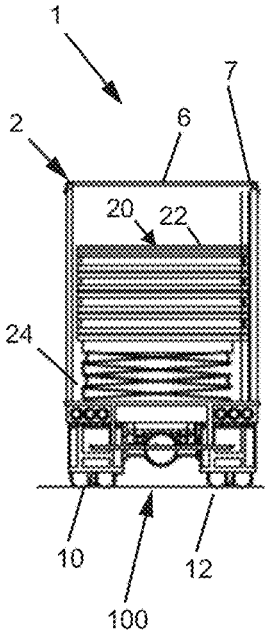
FIG. 1B is a rear view of the apparatus including the first truck and the first device, with the first device in the first state.
Figure 2A:
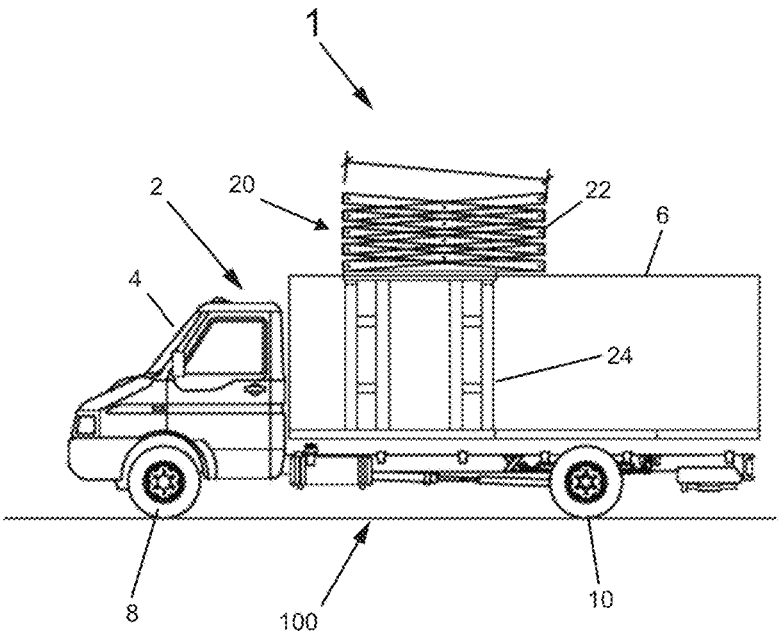
FIG. 2A is a right side view of the apparatus including the first truck and the first device, with the first device in a second state.
Figure 2B:
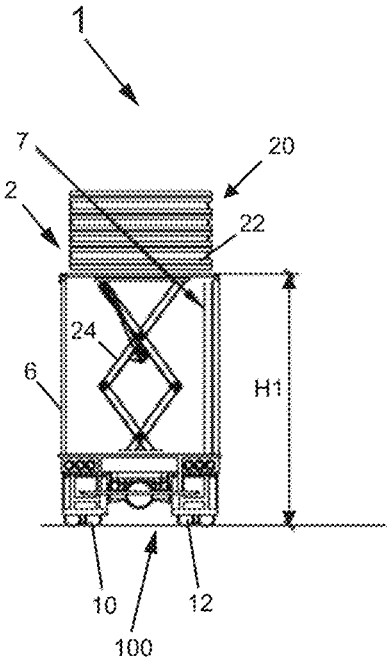
FIG. 2B is a rear view of the apparatus including the first truck and the first device, with the first device in the second state.
Figure 3:
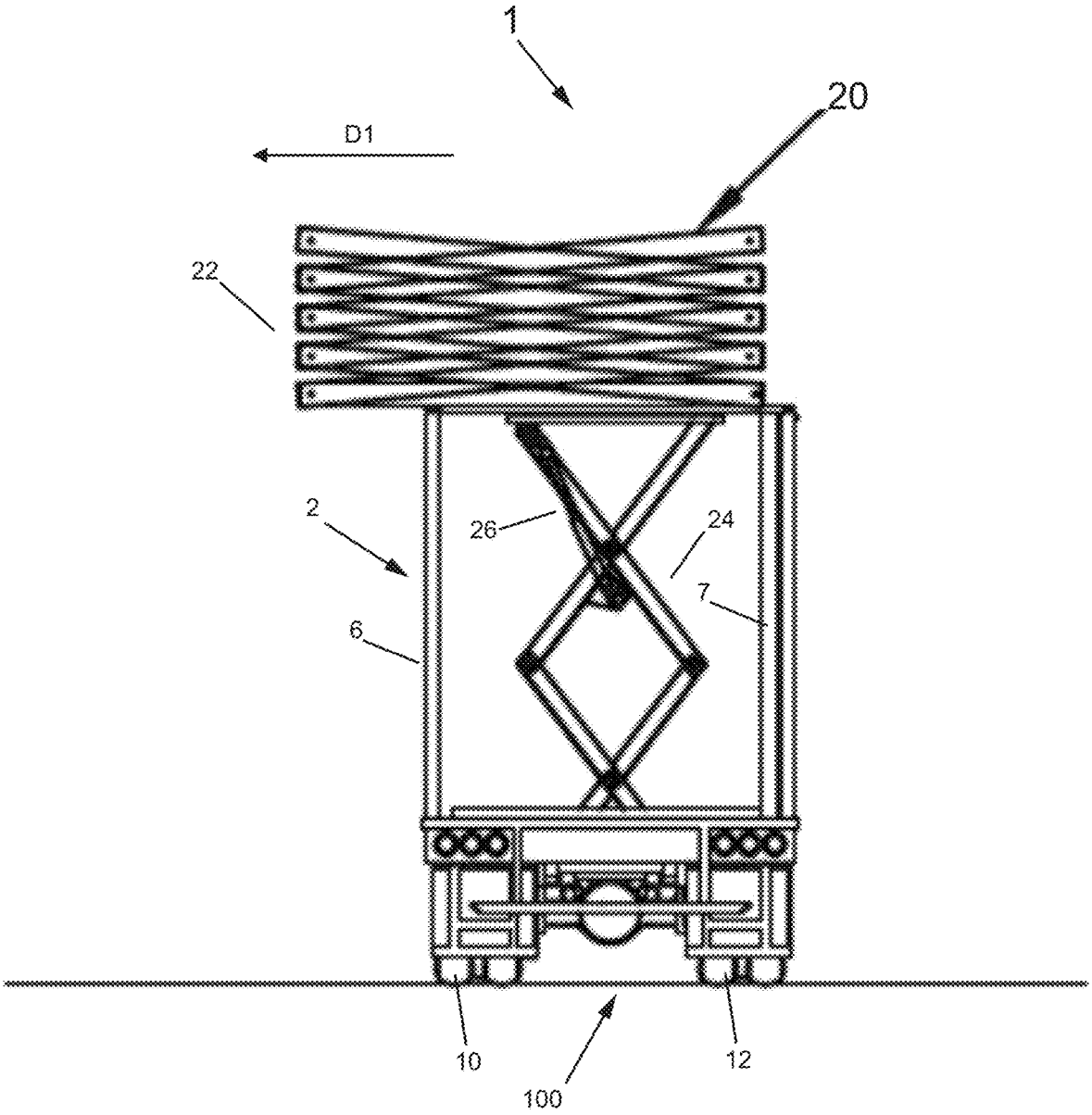
FIG. 3 is a rear view of the apparatus including the first truck and the first device, with the first device in a third state.

FIG. 1A is a right side view of an apparatus 1 including a first truck 2 and a first device 20, with the first device 20 in a first state. FIG. 1B is a rear view of the apparatus 1 including the first truck 2 and the first device 20, with the first device 20 in the first state. FIG. 2A is a right side view of the apparatus 1 including the first truck 2 and the first device 20, with the first device 20 in a second state. FIG. 2B is a rear view of the apparatus 1 including the first truck 2 and the first device 20, with the first device 20 in the second state. FIG. 3 is a rear view of the apparatus 1 including the first truck 2 and the first device 20, with the first device 20 in a third state.

The first truck 2 includes a cab section 4, and a cargo enclosure or section 6. The first truck 2 further includes wheels (or sets of wheels) 8, 10, 12, and another similar or identical wheel which is not shown for the passenger side of the first truck 2. The first truck 2 is shown sitting on a road or road surface 100. It is critical, in at least one embodiment, that the cargo enclosure or section 6 be reinforced by a steel column 7, shown in FIGS. 1B and 2B, on at least a side that will be nearest to a second truck 72 shown in FIG. 6, to support a walkway device 50.

The first device 20 includes a collapsible/expandable portion 22, a hydraulic lift collapsible/expandable portion 24, a device 26 (shown in FIG. 3) for translating the portion 22 from the state of FIG. 2B to the state of FIG. 3, where portion 22 has been moved in the direction D1, from the position shown in FIG. 2B to the position shown in FIG. 3. This is done to position the portion 22 on the top of the cargo enclosure 6 of the truck 2 in preparation for rotation. The first device 20 also includes a device 32, shown in FIG. 4, for rotating the portion 22 from the position of FIG. 3 to the position of FIG. 4.

Figure 4:
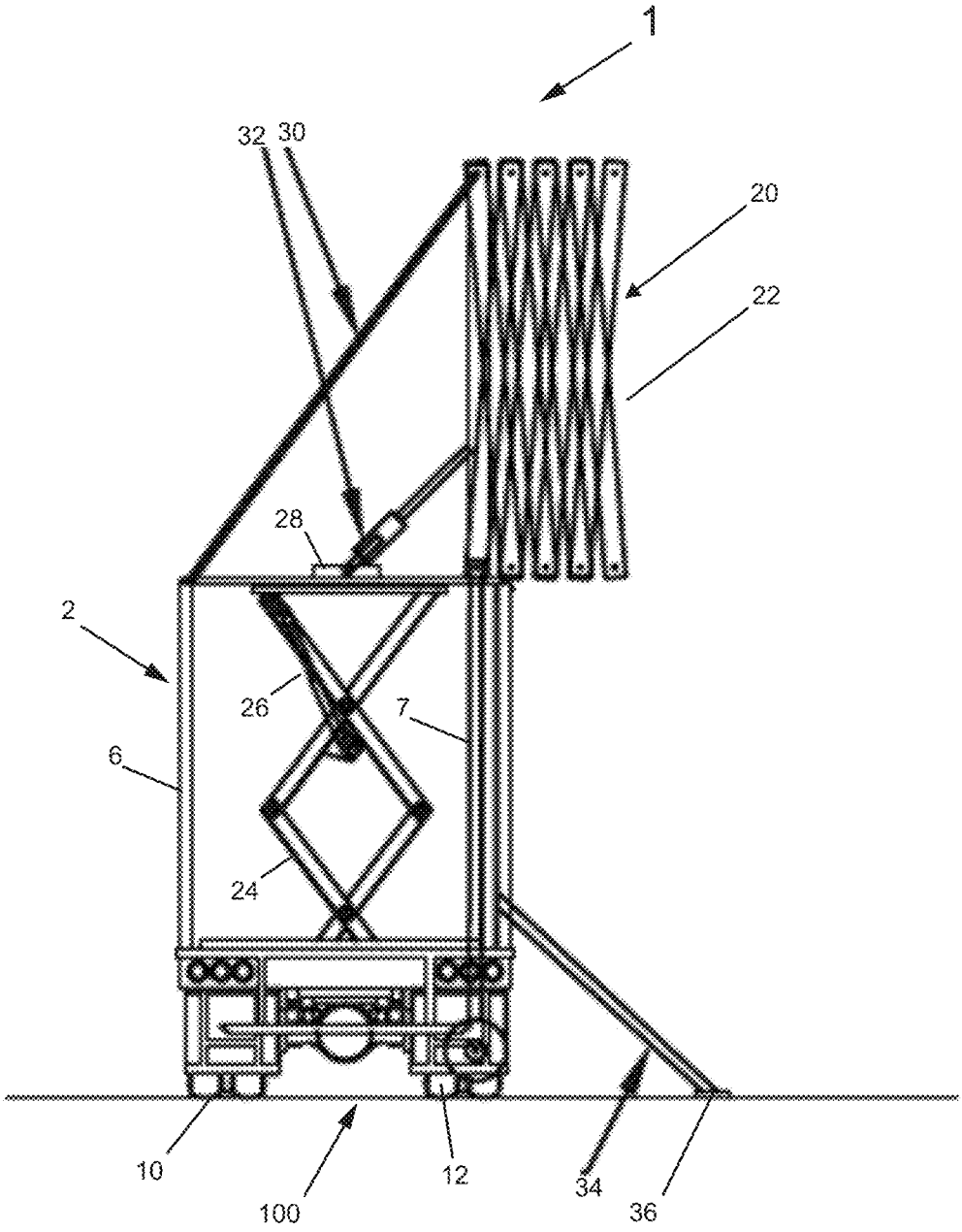
FIG. 4 is a rear view of the apparatus including the first truck and the first device, with the first device in a fourth state, and with one or more support and lifting components employed.

FIG. 4 is a rear view of the apparatus 1 including the first truck 2 and the first device 20, with the first device 20 in a fourth state, and support components 30, 34, and 36 shown and employed.

Figure 5:
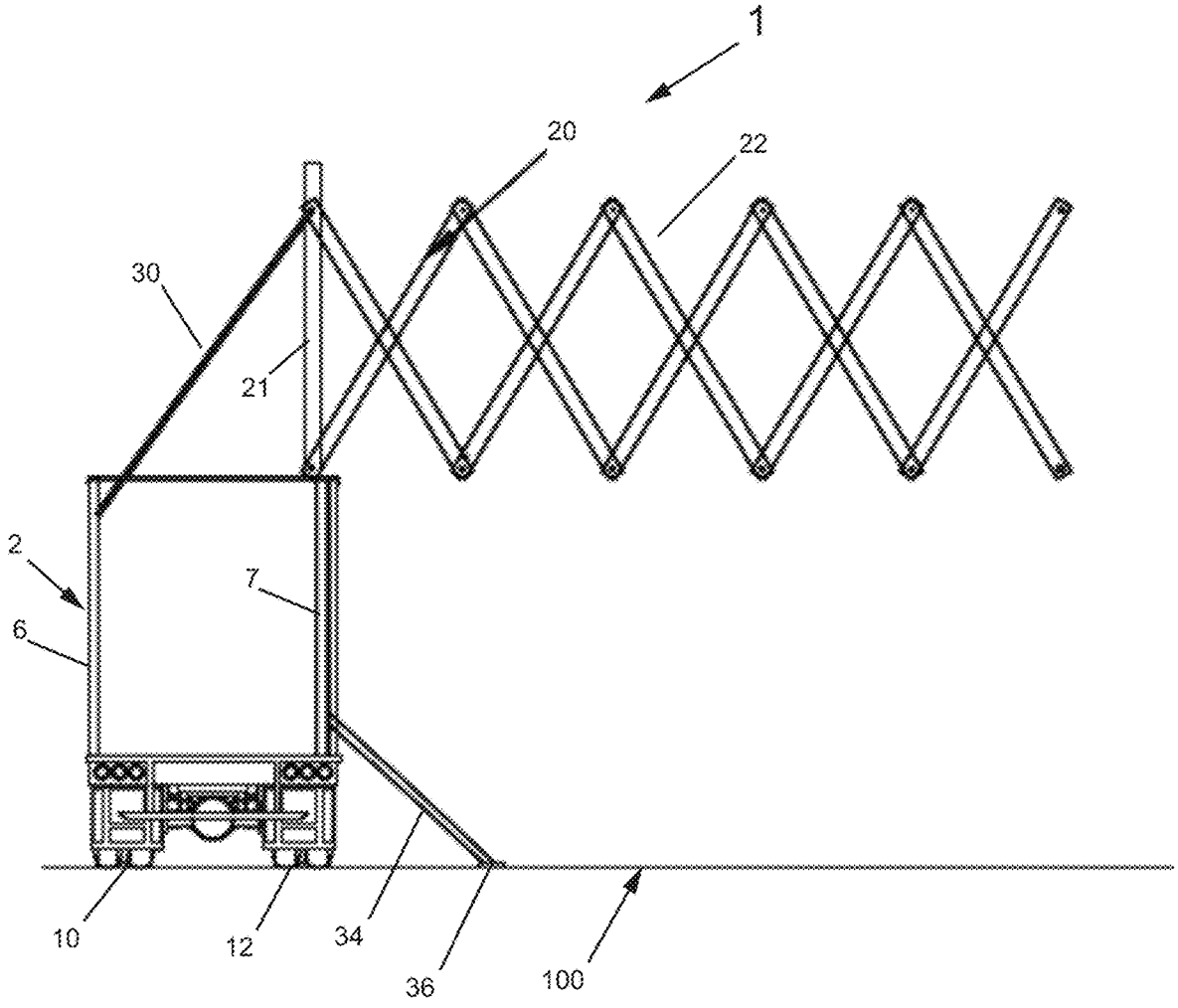
FIG. 5 is a rear view of the apparatus including the first truck and the first device, with the first device in a fifth state, with the one or more support components employed, and with lifting components not shown.

FIG. 5 is a rear view of the apparatus 1 including the first truck 2 and the first device 20, with the first device 20 in a fifth state, with the support components 30, 34, and 36 employed, and with further components not shown. FIG. 5 illustrates the act of extending the bridge span or portion 22 across, so it can be connected to a second truck 202 as shown in FIG. 6.

Figure 6:
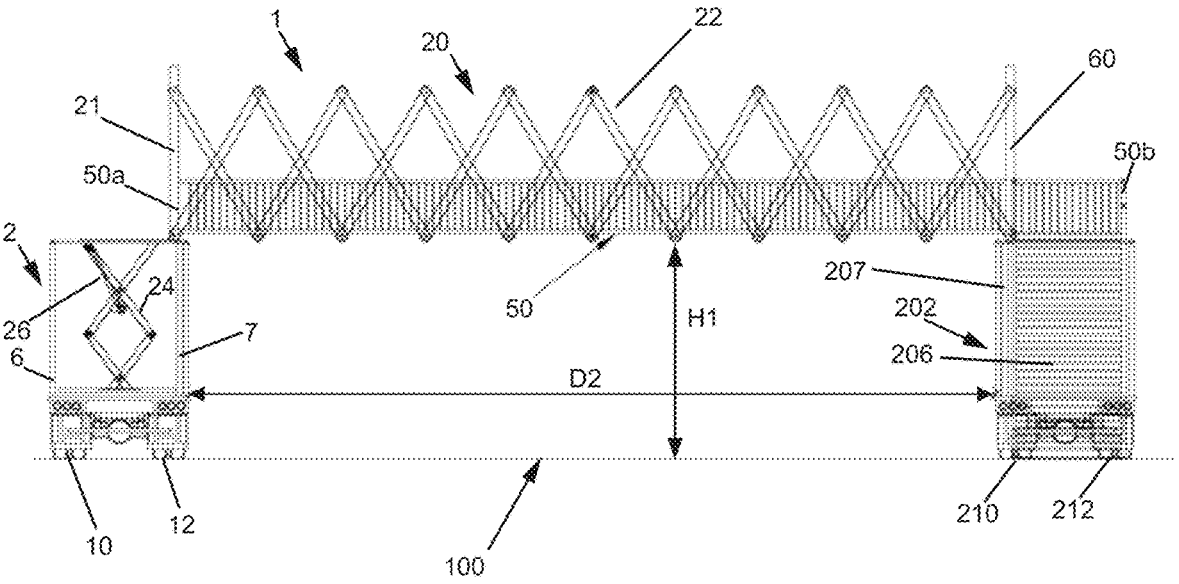
FIG. 6 is a rear view of the apparatus including the first truck and the first device, with the first device in a sixth state, with the one or more support components removed once an extended bridge span of the first device is locked in place with the second truck, and further including sectional decking and/or a walkway device and railing pieces installed, and a second truck.

FIG. 6 is a rear view of the apparatus 1 including the first truck 2 and the first device 20, with the first device 20 in a sixth state, with the one or more support components 30, 34, and 36 removed, and further including a walkway device 50, and a second truck 202.

The walkway device 50 may stretch out from first end 50*a* to second end 50*b*. The walkway device 50 is supported by the first truck 2, the portion 20 and the second truck 202.

The second truck 202 may be identical or substantially similar to the first truck 2, except as will be described. The second truck 202 may include a cargo enclosure 206, and a steel reinforcing column 207 on the side nearest the first truck 2. Thus, reinforcing column 207 faces reinforcing column 7, such that reinforcing column 7 would typically be on the right side of the truck 2, while reinforcing column 207 would be on the left side of the truck 202. The second truck 202 may include wheels or sets of wheels 210 and 212 (and two other wheels or sets of wheels not shown in FIG. 6).

The combination of apparatus 1, walkway device 50 and second truck 202, and/or one or more further components, are configured to be used as a temporary pedestrian walkway over a roadbed, parking lot, field, etc., such as road 100 shown in FIG. 6. This is particularly useful for a mass participation event, such as a marathon road race.

Figure 11A:
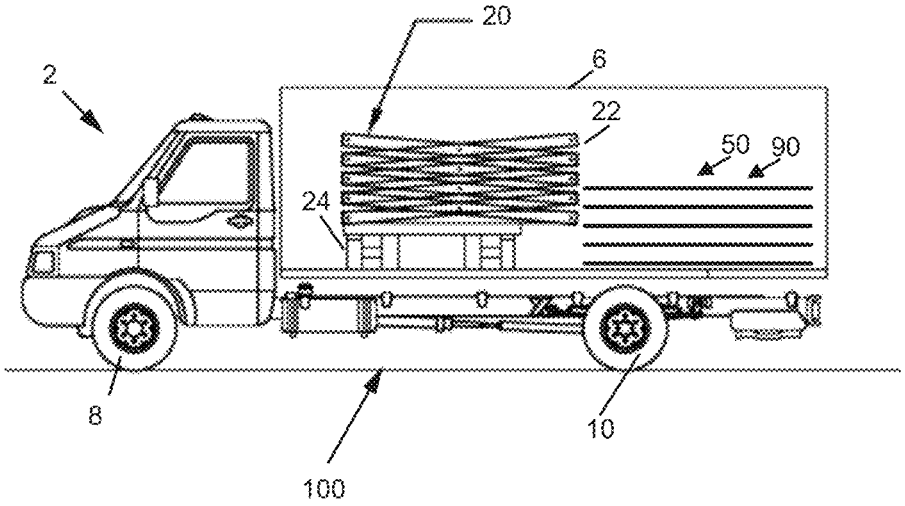
FIG. 11A is a right side view of an apparatus including the first truck and the first device, with the first device in a first state; and also with the walkway device and the collapsed first stairs device.
Figure 11B:
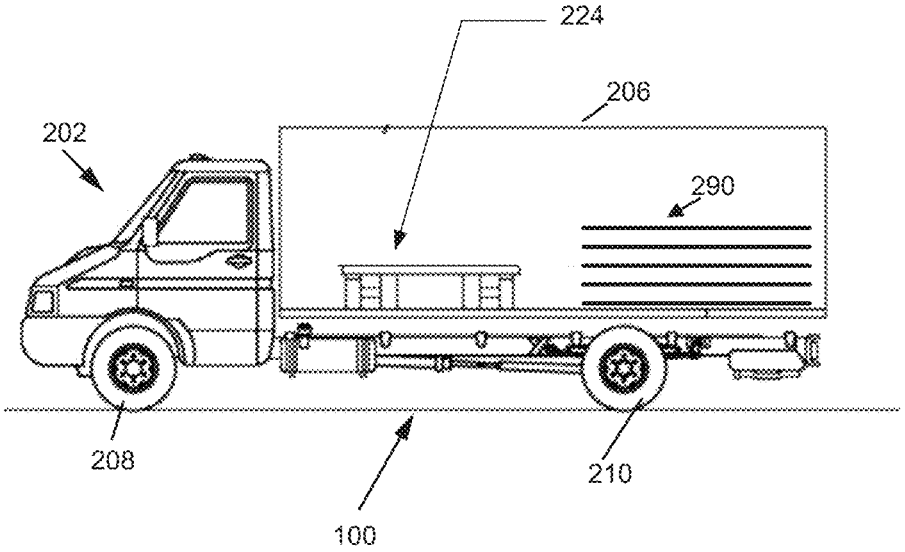
FIG. 11B is a right side view of an apparatus including the second truck and a collapsed hydraulic jacks device, with the collapsed hydraulic jacks device in a collapsed state; and also with a collapsed second stairs device.

In at least one embodiment, each of the first truck 2 and the second truck 202 has a prefabricated collapsable staircase, railings and flooring/decking sectional pieces stored in their cargo enclosure or cargo box. For example, first truck 2 may include device 20, walkway device 50 and first stairs device 90, each in a collapsed state in cargo box 6 as shown in FIG. 11A. Second truck 202 may include collapsed hydraulic lift device 224, and second stairs device 290, each in a collapsed state in cargo box 206 as shown in FIG. 11B.

Figure 7:
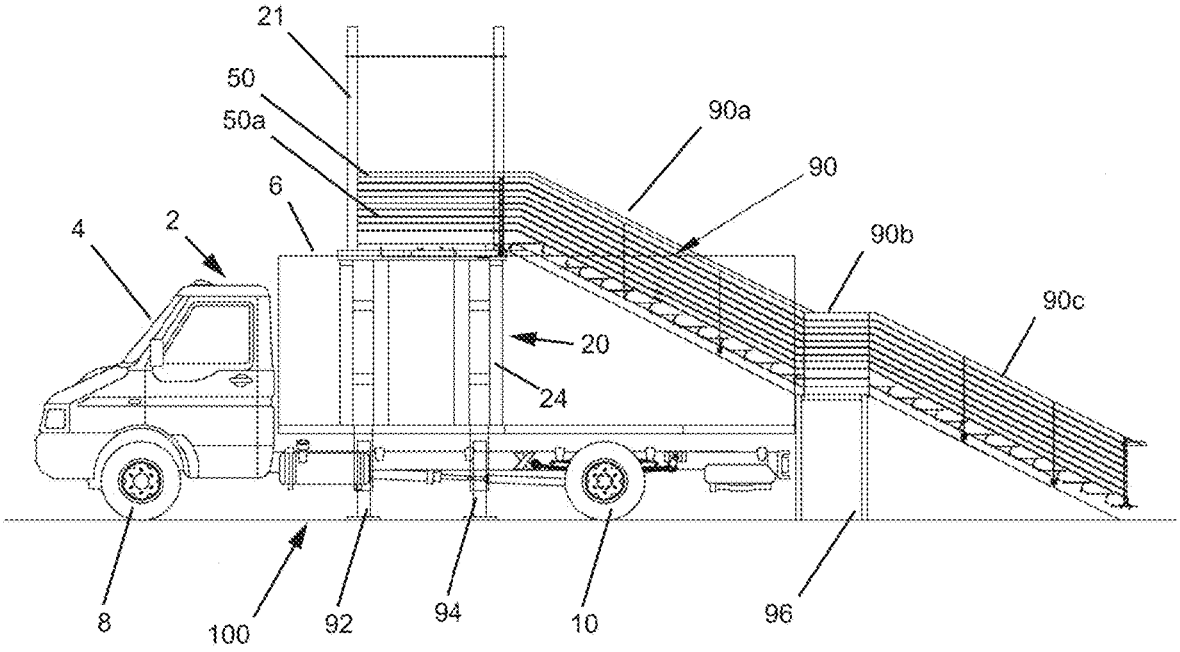
FIG. 7 is a side view of the first truck and the first device in the sixth state, with the walkway device, and with a first stairs device shown.
Figure 8:
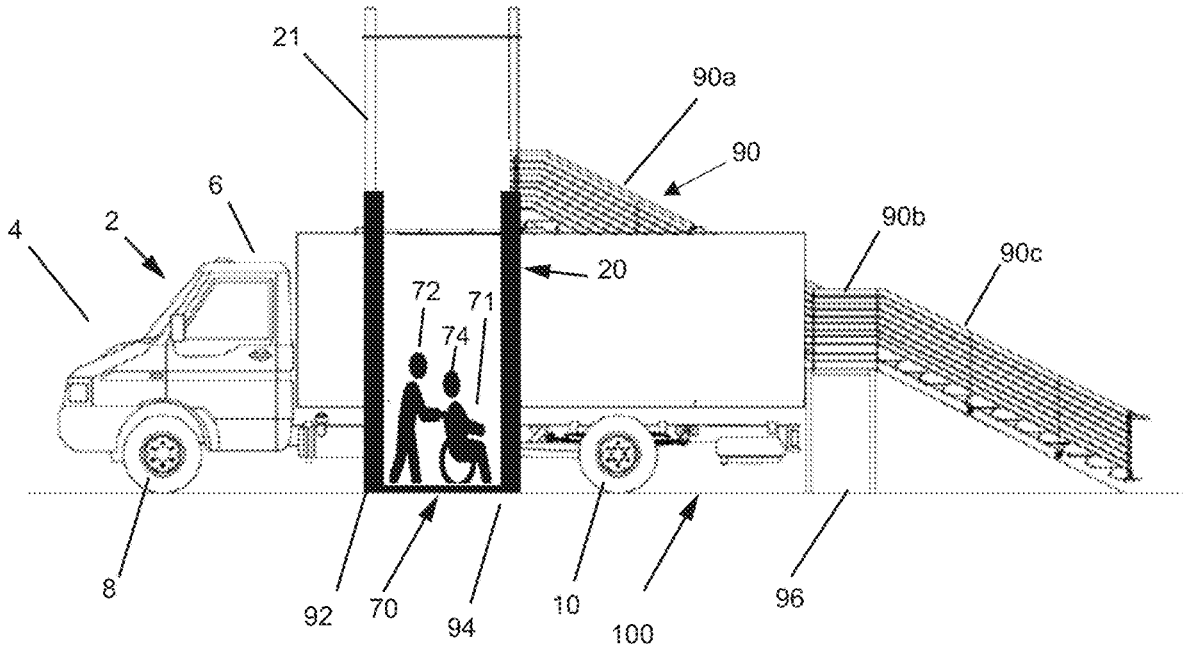
FIG. 8 is a side view of the first truck and the first device in the sixth state, with part of the walkway device not shown, with the first stairs device shown, and with a first elevator device shown.
Figure 9:
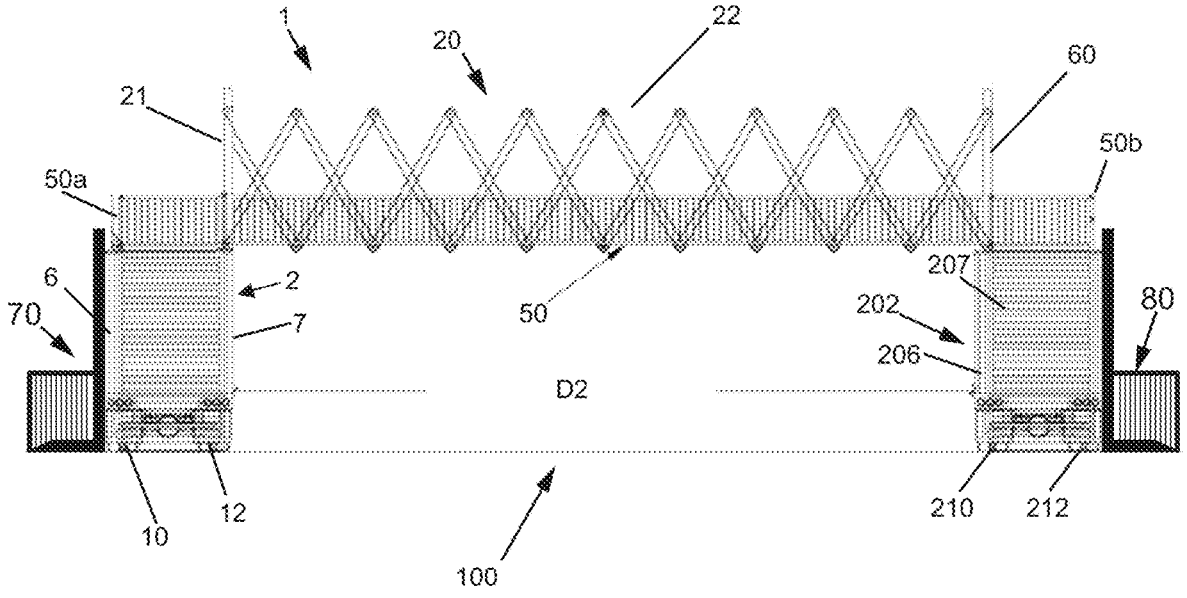
FIG. 9 is a rear view of the apparatus including the first truck and the first device, with the first device in the sixth state, with the one or more support components removed once the extended bridge span of the first device is locked in place with the second truck, further including a sectional decking and/or a walkway device and railing pieces installed, the second truck; and first and second elevator devices.

In operation, in at least one embodiment, the trucks 2 and 202 pull into position on either side of the road 100, such as shown in FIG. 6. The collapsed bridge span or portion 22 is raised by the expanding of the hydraulic lift device 24 above the cargo box 6 and extended across to the second truck 202 and locked in place as shown in FIG. 6 or FIG. 9. The collapsed pre-fabricated aluminum staircase sectionals or staircase devices 90 and 290, are then installed from the ground (road 100) up to the bridge span 22 extending out of the back of trucks 2 and 202, respectively, and then sectional aluminum flooring/decking pieces and railing, which may make up walkway device 50 are installed across the bridge span or portion 22. The first stair device 90 is shown by FIGS. 7, and 8, in a fully expanded form, and the second stair device 290 may be identical or substantially similar to the first stair device 90.

In at least one embodiment, it is critical that the bridge platform or portion 22 of the first device 20, be an articulating scissor design. The platform or portion 22 rises above the first truck 2, as shown by FIGS. 3 and 4, and extends perpendicularly from the first truck 2 to a landing on the second truck 202, as shown by FIGS. 5 and 6.

In at least one embodiment, ideally, there is an ADA (American Disabilities Act) accessible lift and/or elevator device (70 and 80) on the sides of trucks 2 and truck 202, respectively, from the street or road 100 to the cross platform or walkway device 50 as shown in FIG. 9

The completed bridge shown in FIG. 6 and/or FIG. 9, up and over the roadway 100 also offers a highly visible branding opportunity. For example, a company trademark or logo or inspirational message is configured to be placed on the portion 22 in the state of FIG. 6 and/or FIG. 9.

The completed bridge shown in FIG. 6 and/or FIG. 9, may be installed and/or removed in approximately thirty to sixty minutes.

In at least one embodiment, the height or clearance H1, shown in FIG. 6 and in FIG. 2B, from the road surface or road 100 to the bottom of portion 22 should be fourteen feet or more to allow for a firetruck to pass underneath.

The walkway device 50 should provide a six-foot wide walkway for pedestrians to walk across between trucks 2 and 202. Load rating would be a non-issue. With a six-foot wide span or walkway device 50 width, not enough people could fit on the bridge at any one time to create a load concern.

Wind rating would be a non-issue. The trucks 2 and 202 themselves would carry the wind load.

In at least one embodiment, the portion 22 and walkway device 50, and/or the bridge span would be made of lightweight aluminum.

Stabilizer arms or support members 30, 34, and 36, shown in FIG. 4 and FIG. 5, in place for setup would be removed after installation is complete, wherein amount of available footprint under the span, or under portion 22 and walkway device 50 in FIG. 6 is critical.

Span distance D2, shown in FIG. 6, from truck 2 to truck 202, in at least one embodiment, is preferably adjustable, such as from any distance from fifteen feet to forty-two feet.

In at least one embodiment, hydraulics device 24 raises the portion or span 22 above the first truck 2. In at least one embodiment, a hydraulic motor of device 24 scissor articulates the span or portion 22 across from the first truck 2 to the second truck 202

In at least one embodiment, to get to the height needed a landing 90*b* shown in FIG. 7 will be needed mid staircase for the first staircase device 90 shown in FIG. 7 and for a similar or identical second staircase device 290 (shown in collapsed, compressed, and/or simplified form in FIG. 11B.

FIG. 7 is a side view of the first truck 2 and the first device 20 in the sixth state, with the walkway device 50, and with the first stairs device 90. The first stairs device 90 may include a first stairs section 90*a*, a landing section 90*b*, and a second stairs section 90*c*. The landing section 90*b* may be supported by support or stand 96, which may be described as being part of the stairs device 90. FIG. 7 shows a gate section 21, which may be described as part of the first device 20.

FIG. 7 also shows supports or feet 92 and 94 which may be used to lock or mount the first truck 2, the first device 20, and the stairs device 90 in place.

The second stairs device 290, similar or identical to the stairs device 90, is preferably placed at the second truck 202, in a manner similar or identical to that shown for stairs device 90 at the first truck 2. The second stairs device 290 at the truck 202, typically includes components similar or identical to 90*a*, 90*b*, 90*c* and 96. A second set of supports or stands, similar or identical to stands or supports 92 and 94 at the first truck 2, are preferably typically placed at the second truck 202, in a manner similar or identical to that shown for supports 92 and 94.

After installation of the first stairs device 90 (in an expanded form), at the first truck 2, as shown in FIG. 7, and a similar or identical second stairs device 290 (in an expanded form) at the second truck 202, pedestrians can walk onto stair section 90*c*, then section 90*b*, then section 90*a*, then onto walkway device 50, then over the road or street 100 shown in FIG. 6, and then down a section similar or identical to section 90*a* (but at truck 202), then to a section similar or identical to section 90*b* (but at truck 202), then to a section similar or identical to section 90*c* (but at truck 202), and then the pedestrian can proceed off of section 90*c*, on the other side of the road 100.

In operation, the first staircase 90 is in collapsable pre-fabricated sections and is lifted into place by hand, connecting from the bridge span or portion 22 to top landing of walkway device 50, near end 50*a* shown in FIG. 6 and/or FIG. 9, and from the landing, near end 50*a*, to the ground (road 100). Similarly or identically, the second staircase 290 is in collapsable pre-fabricated sections and is lifted into place by hand, connecting from the bridge span or portion 22 to top landing of walkway device 50, near end 50*b* shown in FIG. 6 and/or FIG. 9, and from the landing, near end 50*b*, to the ground (road 100). Next flooring/decking sections and railing sections of walkway device 50 are preferably installed by hand across the span 22.

FIG. 8 is a side view of the first truck 2 and the first device 20 in the sixth state, with part of the walkway device 50 not shown, with the first stairs device 90 shown, and with a first elevator device 70 shown. FIG. 8 shows a standing human caregiver 72 and a person 74 in a wheelchair. Preferably, the first elevator device 70 has a compartment 71 shown by FIGS. 10A-10C, which allows the caregiver 72 and person 74 to fit in the compartment 71.

FIG. 9 is a rear view of the apparatus 1 including the first truck 2 and the first device 20, with the first device 20 in the sixth state, with the one or more support components removed once the extended bridge span or portion 22 of the first device 20 is locked in place with the second truck 202, further including a sectional decking and/or a walkway device 50 and railing pieces installed, the second truck 202; and first 70 and second 80 elevator devices. The first elevator device 70 may be identical to the second elevator device 80, and/or devices 70 and 80 may be mirror images of each other.

Figure 10A:
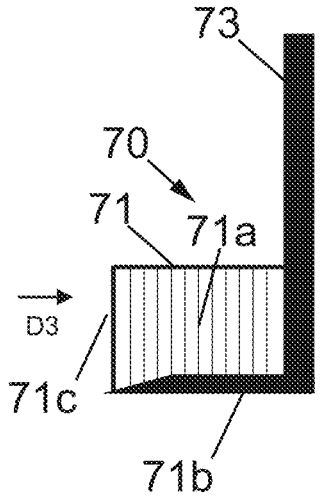
FIG. 10A shows part of the first elevator device in a first state in which an elevator basket, compartment or cab is at a floor or street level so at least one caregiver and a person in a wheel chair can get into the elevator compartment.

FIG. 10A shows part of the first elevator device 70 in a first state in which an elevator basket, compartment or cab 71 is at a floor or street level so at least one caregiver 72 and a person 74 in a wheelchair can get into the elevator compartment 71. The compartment 71 is surrounded by fencing or rails 71*a*, and has a gate entrance opening 71*c* allowing the individuals 72 and 74 to enter the cab 71 via direction D3, and then to close the gate 71*c*, so the cab 71 has its perimeter completely surrounded by fencing or rails 71*a*. The cab 71 has a floor 71*b*, which may start on the road 100 shown in FIG. 9, in the state of FIG. 10A.

Figure 10B:
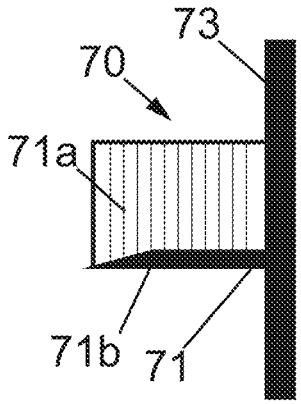
FIG. 10B shows part of the first elevator device in a second state in which the elevator basket, compartment or cab is at a middle level during its transit in the direction U1 from the floor level to an upper or top level.
Figure 10C:
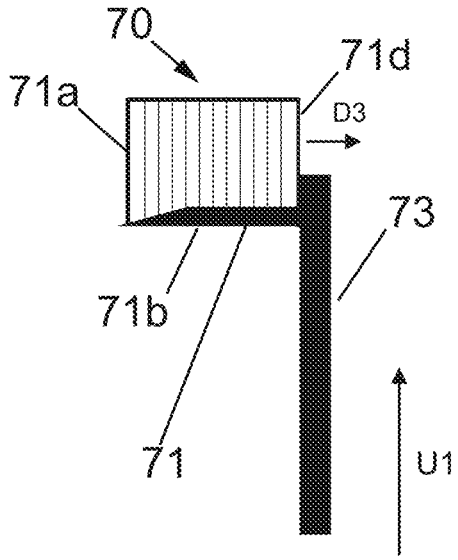
FIG. 10C shows part of the first elevator device in a third state in which the elevator compartment is at a top level.

FIG. 10B shows part of the first elevator device 70 in a second state in which the elevator basket, compartment or cab 71 is at a middle level during its transit in the direction U1 from the floor level, of FIG. 10A, to an upper or top level of FIG. 10C.

FIG. 10C shows part of the first elevator device 70 in a third state in which the elevator compartment 71 is at a top level, which typically would be where the floor 71*b* of the cab 71 is level or even with the floor of walkway device 50 shown in FIG. 9. A person may exit the compartment 71 out in the direction D3 though a gate 71*d* provided in the fencing or railings 71*a*.

The operation of second elevator device 80 shown in FIG. 9, is typically identical or substantially similar to the operation of first elevator device 70.

FIG. 11A is a right side view of an apparatus 1 including the first truck 2 and the first device 20, with the first device 20 in a first state; and also with the walkway device 50 and the collapsed first stairs device 90. and FIG. 11B is a right side view of an apparatus including the second truck 202 and a collapsed hydraulic jacks device 224, with the collapsed hydraulic jacks device 224 in a collapsed state; and also with a collapsed second stairs device 290.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:
an expandable lift device; and
an expandable bridge span;
wherein the expandable lift device is connected to the expandable bridge span;
wherein the expandable lift device is configured to raise the expandable bridge span, while the expandable bridge span is in a compressed state and is substantially aligned with the expandable lift device;
wherein the expandable bridge span is configured to rotate about ninety degrees with respect to the expandable lift device, while the expandable bridge span is in the compressed state;
wherein the expandable bridge span is configured to expand perpendicularly to the expandable lift device; and further comprising
a first truck with a cargo enclosure; and
wherein when both the expandable bridge span and the expandable lift device are in a compressed state and connected together, both the expandable bridge span and the expandable lift device fit within the cargo enclosure.

2. The apparatus of claim 1 further comprising
a first staircase; and
wherein the first staircase is configured to be attached to the expandable bridge span, at a first end of the expandable bridge span, when the expandable bridge span is in a first expanded state to allow a human being to walk up the first staircase and then onto a walkway device supported by the expandable bridge span.

3. The apparatus of claim 1 further comprising
a second truck; and
wherein, in the first expanded state, the expandable bridge span is configured to span from the first truck to the second truck.

4. The apparatus of claim 3 further comprising
a second staircase; and
wherein the second staircase is configured to be attached to a second end of the expandable bridge span, which is opposite the first end of the expandable bridge span, when the expandable bridge span is in the first expanded state to allow a human being to walk up the first staircase, then onto the walkway device, supported by the expandable bridge span, and then onto the second staircase.

5. The apparatus of claim 4 wherein
the second staircase, in a compressed state, fits within a cargo enclosure of the second truck.

6. An apparatus comprising:
an expandable lift device; and
an expandable bridge span;
wherein the expandable lift device is connected to the expandable bridge span;
wherein the expandable lift device is configured to raise the expandable bridge span, while the expandable bridge span is in a compressed state and is substantially aligned with the expandable lift device;
wherein the expandable bridge span is configured to rotate about ninety degrees with respect to the expandable lift device, while the expandable bridge span is in the compressed state;
wherein the expandable bridge span is configured to expand perpendicularly to the expandable lift device; and
further comprising
a first staircase; and
wherein the first staircase is configured to be attached to the expandable bridge span, at a first end of the expandable bridge span, when the expandable bridge span is in a first expanded state to allow a human being to walk up the first staircase and then onto a walkway device supported by the expandable bridge span; and
further comprising
a first truck with a cargo enclosure; and
wherein when both the expandable bridge span and the expandable lift device are in a compressed state and connected together, all of the expandable bridge span, the expandable lift device, and the first staircase in a compressed state, fit within the cargo enclosure of the first truck.

7. A method comprising
placing an expandable lift device in a compressed state and an expandable bridge span in a compressed state in a cargo enclosure of a first truck;
raising the expandable bridge span while the expandable bridge span is in a compressed state and is substantially aligned with the expandable lift device;
rotating the expandable bridge span about ninety degrees with respect to the expandable lift device, while the expandable bridge span is in the compressed state; and
expanding the expandable bridge span perpendicularly to the expandable lift device.

8. The method of claim 7 further comprising
attaching a first staircase to the expandable bridge span, at a first end of the expandable bridge span, when the expandable bridge span is in a first expanded state to allow a human being to walk up the first staircase and then onto a walkway device supported by the expandable bridge span.

9. The method of claim 8 wherein when both the expandable bridge span and the expandable lift device are in a compressed state and connected together, all of the expandable bridge span, the expandable lift device, and the first staircase in a compressed state, fit within a cargo enclosure of the first truck.

10. The method of claim 7 further comprising expanding the expandable bridge span so that it spans from the first the first truck to a second truck.

11. The method of claim 8 further comprising expanding the expandable bridge span so that it spans from the first the first truck to a second truck.

12. The method of claim 11 further comprising attaching a second stair case to a second end of the expandable bridge span, which is opposite the first end of the expandable bridge span, when the expandable bridge span is in the first expanded state to allow a human being to walk up the first staircase, then onto the walkway device, supported by the expandable bridge span, and then onto the second staircase.

13. The method of claim 12 wherein the second staircase, in a compressed state, fits within a cargo enclosure of the second truck.

* * * * *